US006432889B1

(12) United States Patent
Kinoshita et al.

(10) Patent No.: US 6,432,889 B1
(45) Date of Patent: Aug. 13, 2002

(54) GREASE COMPOSITION

(75) Inventors: Hirotugu Kinoshita; Kiyomi Sakamoto, both of Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/353,717

(22) Filed: Jul. 14, 1999

(30) Foreign Application Priority Data

Jul. 15, 1998 (JP) ..... 10-200334
Sep. 18, 1998 (JP) ..... 10-264419

(51) Int. Cl.[7] ..... C10M 169/06
(52) U.S. Cl. ..... 508/399; 508/391; 508/335; 508/552; 508/570; 508/569
(58) Field of Search ..... 508/399, 391, 508/570, 552, 335, 569

(56) References Cited

U.S. PATENT DOCUMENTS 2,192,874 A * 3/1940 Smith et al.
2,205,858 A * 6/1940 Mikeska et al.
2,526,041 A * 10/1950 Olin
2,718,501 A * 9/1955 Harle
3,897,350 A * 7/1975 Heiba et al.
4,668,409 A * 5/1987 Yamaguchi et al.
4,780,231 A * 10/1988 Kinoshita et al.
4,915,860 A * 4/1990 Kinoshita et al.
5,037,565 A * 8/1991 King
5,135,670 A * 8/1992 Johnson et al.
5,294,354 A * 3/1994 Papke et al.
5,338,468 A * 8/1994 Arvizzigno et al.
5,487,839 A * 1/1996 Vinci et al.
5,589,444 A * 12/1996 Hatakeyama
5,604,187 A * 2/1997 Takeuchi et al.
5,607,906 A * 3/1997 Okaniwa et al.
5,622,923 A * 4/1997 Mathur et al.
5,650,380 A * 7/1997 Fletcher
5,854,183 A * 12/1998 Hasegawa et al.
5,858,931 A * 1/1999 Tanaka et al.
6,022,835 A * 2/2000 Fletcher
6,037,314 A * 3/2000 Kondo et al.

FOREIGN PATENT DOCUMENTS

| | | | | |
|---|---|---|---|---|
| DE | 19723960 A1 | 12/1997 | ..... | C10M/169/06 |
| EP | 0796910 A1 | 9/1997 | ..... | C10M/169/06 |
| EP | 0811675 A1 | 12/1997 | ..... | C10M/169/06 |
| JP | 10183162 | 7/1998 | ..... | C10M/169/06 |

* cited by examiner

*Primary Examiner*—Jerry D. Johnson
(74) *Attorney, Agent, or Firm*—Darby & Darby

(57) ABSTRACT

A grease composition is disclosed which contains a lubricating base oil, and: (A) 2 to 30 wt % of a urea thickener, (B) 0.1 to 20 wt % of a sulfur-containing extreme pressure agent selected from the group consisting of dihydrocarbyl polysulfide, sulfurized oils and fats and mixtures thereof, and (C) 0.05 to 10 wt % of a sulfonate selected from the group consisting of an over-based zinc sulfonate, an over-based magnesium sulfonate and mixtures thereof having total base number of 100 to 500 mgKOH/g, each based on a total amount of said composition.

14 Claims, No Drawings

GREASE COMPOSITION

FIELD OF ART

This invention relates to a grease composition, particularly a grease composition suitable for a constant velocity joint.

BACKGROUND ART

A constant velocity joint is used in a system for transmitting driving force, e.g., transmitting the force from a transmission gearbox to tires on a car. The constant velocity joint includes fixed type joints such as a Birfield joint, a Rzeppa joint and an undercutting free joint, and slide type joints such as a double off-set joint, a tripod joint and a cross groove joint.

A conventional grease which has been mainly used for such constant velocity joints contains a base grease consisting of a lubricating base oil and a lithium soap and/or urea thickener, and additives such as molybdenum disulfide and a lead compound.

The grease for the constant velocity joint is required to exhibit performances such as anti-flaking, anti-seizure, abrasion resistance, and low friction. However, the performance of the conventional grease hardly catches up with the tendency to improved performance and quality of recent cars. Thus, particularly in order to prolong the lifetime of a constant velocity joint, improvement of a grease in the anti-flaking property is desired.

DISCLOSURE OF THE INVENTION

The object of the present invention is to provide a grease composition for a constant velocity joint that exhibits superior anti-flaking performance.

According to the present invention, there is provided a grease composition comprising a lubricating base oil, and: (A) 2 to 30 wt % of a urea thickener, (B) 0.1 to 20 wt % of a sulfur-containing extreme pressure agent selected from the group consisting of dihydrocarbyl polysulfide, sulfurized oils and fats and mixtures thereof, and (C) 0.05 to 10 wt % of a sulfonate selected from the group consisting of an over-based zinc sulfonate, an over-based magnesium sulfonate and mixtures thereof having total base number of 100 to 500 mgKOH/g, each based on a total amount of said grease composition.

PREFERRED EMBODIMENTS OF THE INVENTION

The present grease composition contains a lubricating base oil. The lubricating base oil may be a mineral oil and/or a synthetic oil. The kinematic viscosity of the lubricating base oil may be 2 to 40 $mm^2/s$, and preferably 3 to 20 $mm^2/s$ at 100° C. The viscosity index of the lubricating base oil may be not less than 90, and preferably not less than 100.

The mineral oil may be obtained by a conventional method commonly performed in a lubricating oil production process in oil refining industries. For example, the mineral oil may be obtained by preparing lubricant fractions of crude oil by distillation under atmospheric or reduced pressure, and then refining the lubricant fractions by at least one treatment selected from solvent deasphalting, solvent extraction, hydrocracking, solvent dewaxing, contact dewaxing, hydrofining, washing with sulfuric acid, clay treatment, and the like.

Examples of the synthetic oil may include poly-α-olefins such as polybutene, 1-octen oligomer and 1-decene oligomer, or hydrides of these poly-α-olefins; diesters such as ditridecyl glutarate, di-2-ethylhexyl adipate, diisodecyl adipate, ditridecyl adipate, or di-3-ethylhexyl sebacate; polyol esters such as trimethylolpropane caprylate, trimethylolpropane pelargonate, pentaerythritol-2-ethyl hexanoate, or pentaerythritol pelargonate; alkylnaphthalene; alkylbenzene; polyoxyalkylene glycol; polyphenyl ether; dialkyl diphenyl ether, silicone oil; and mixtures thereof.

The present grease composition contains (A) a specific content of a urea thickener. The component (A) may be a urea compound, a urea-urethane compound, a urethane compound or mixtures thereof.

Examples of the urea compound, urea-urethane compound and urethane compound may include a diurea compound, a triurea compound, a tetraurea compound, polyurea compounds other than diurea, triurea and tetraurea compounds, a urea-urethane compound, a diurethane compound and mixtures thereof. More specifically, any of compounds represented by the general formula (1) or mixtures thereof are preferable.

$$A—CONH—R^1—NHCO—B \quad (1)$$

In the formula (1), $R^1$ denotes a divalent hydrocarbon group. A and B are the same or different groups, and denote $—NHR^2$, $—NR^3R$, or $—OR^5$. $R^2$, $R^3$, $R^4$ and $R^5$ are the same or different groups and denote a hydrocarbon residue having 6 to 20 carbon atoms.

Preferably, $R^1$ in the formula (1) is a divalent hydrocarbon residue having 6 to 20, more preferably 6 to 15 carbon atoms. The divalent hydrocarbon group may be a straight or branched alkylene group, a straight or branched alkenylene group, a cycloalkylene group or an aromatic group. Specific examples of $R^1$ may include an ethylene group, a 2,2-dimethyl-4-methylhexylene group and groups represented by the following formulae:

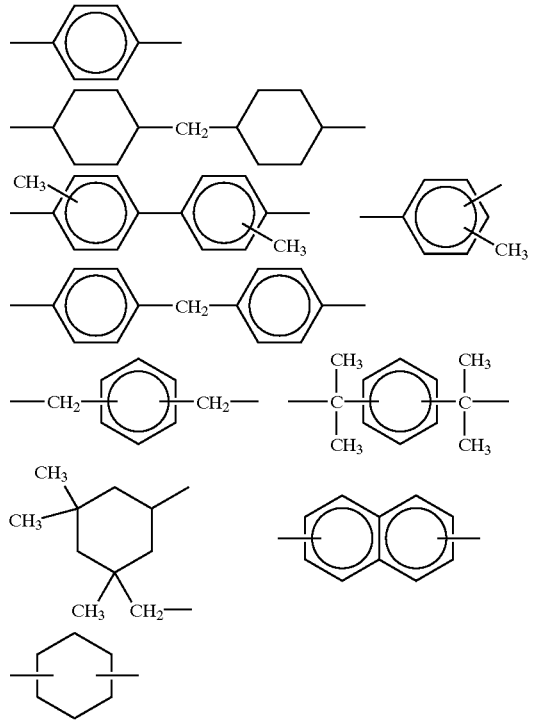

Among these, the following groups are particularly preferred.

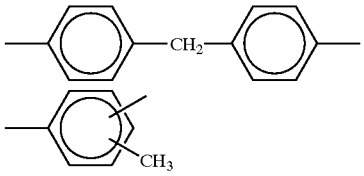

$R^2$, $R^3$, $R^4$ and $R^5$ may be a straight or branched alkyl group, a straight or branched alkenyl group, a cycloalkyl group, an alkylcycloalkyl group, an aryl group, an alkylaryl group, or an arylalkyl group. Specific examples of $R^2$, $R^3$, $R^4$ and $R^5$ may include a straight or branched alkyl group such as a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, or an eicosyl group; a straight or branched alkenyl group such as a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group or an eicosenyl group; a cyclohexyl group; an alkylcycloalkyl group such as a methylcyclohexyl group, a dimethylcyclohexyl group, an ethylcyclohexyl group, a diethylcyclohexyl group, a propylcyclohexyl group, an isopropylcyclohexyl group, a 1-methyl-3-propylcyclohexyl group, a butylcyclohexyl group, an amylcyclohexyl group, an amylmethylcyclohexyl group, a hexylcyclohexyl group, a heptylcyclohexyl group, an octylcyclohexyl group, a nonylcyclohexyl group, a decylcyclohexyl group, an undecylcyclohexyl group, a dodecylcyclohexyl group, a tridecylcyclohexyl group or a tetradecylcyclohexyl group; an aryl group such as a phenyl group or a naphthyl group; an alkylaryl group such as a toluyl group, an ethylphenyl group, a xylyl group, a propylphenyl group, a cumenyl group, a methylnaphthyl group, an ethylnaphthyl group, a dimethylnaphthyl group or a propylnaphthyl group; or an arylalkyl group such as a benzyl group, a methylbenzyl group or an ethylbenzyl group. Among these, a cyclohexyl group, a octadecyl group, and a toluyl group are particularly preferred.

The diurea compound, the urea-urethane compound, or the diurethane compound may be prepared by reacting diisocyanate represented by the formula OCN—$R^1$—NCO with a compound represented by the formula $R^2NH_2$, $R^3R^4NH$ or $R^5OH$ or mixtures thereof in the base oil at 10 to 200° C. In this case, $R^1$, $R^2$, $R^3$, $R^4$ and $R^5$ are the same as those in the formula (1).

The lower limit of the content of the component (A) is 2 wt % and preferably 5 wt %; and the upper limit is 30 wt % and preferably 20 wt %, based on the total amount of the grease composition. If the content of the component (A) is less than 2 wt %, the component does not exhibit sufficient thickening effect, and the composition cannot thus be in a sufficiently greasy state. If the content of the component is more than 30 wt %, the composition becomes too hard as a grease to exhibit sufficient lubricating performance.

The present grease composition contains as component (B) a specific content of a sulfur-containing extreme pressure agent selected from the group consisting of dihydrocarbyl polysulfide, sulfurized oils and fats, and mixtures thereof.

The dihydrocarbyl polysulfide is a sulfur-containing compound which is generally called polysulfide or sulfurized olefin. Specifically, the dihydrocarbyl polysulfide may be represented by the formula (2);

$$R^6—(S)x-R^7 \quad (2)$$

wherein $R^6$ and $R^7$ may be the same or different groups, and each stands for a straight or branched alkyl group having 3 to 20 carbon atoms, or an aryl, alkylaryl or arylalkyl group having 6 to 20 carbon atoms. X stands for a number of 2 to 6, preferably 2 to 5. Examples of $R^6$ and $R^7$ may include a straight or branched alkyl group such as a n-propyl group, an isopropyl group, a n-butyl group, an isobutyl group, a sec-butyl group, a tert-butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group and an icosyl group; an aryl group such as a phenyl group and a naphthyl group; an alkylaryl group such as a tolyl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a xylyl group, an ethylmethylphenyl group, a diethylphenyl group, a dipropylphenyl group, a dibutylphenyl group, a methylnaphthyl group, an ethylnaphthyl group, a propylnaphthyl group, a butylnaphthyl group, a dimethylnaphthyl group, an ethylmethylnaphthyl group, a diethylnaphthyl group, a dipropylnaphthyl group and a dibutylnaphthyl group, including all of the structural isomers; and an arylalkyl group such as a benzyl group, a phenylethyl group and a phenylpropyl group, including all of the structural isomers.

Among these, each of $R^6$ and $R^7$ of the formula (2) may preferably be an alkyl group derived from a propylene, a 1-butene or an isobutylene and having 3 to 18 carbon atoms, or an aryl, alkylaryl or arylalkyl group having 6 to 8 carbon atoms. Specifically, an alkyl group such as an isopropyl group, branched hexyl groups derived from propylene dimers, branched nonyl groups derived from propylene trimers, branched dodecyl groups derived from propylene tetramers, branched pentadecyl groups derived from propylene pentamers, branched octadecyl groups derived from propylene hexamers, a sec-butyl group, a tert-butyl group, branched octyl groups derived from 1-butene dimers, branched octyl groups derived from isobutylene dimers, branched dodecyl groups derived from 1-butene trimers, branched dodecyl groups derived from isobutylene trimers, branched hexadecyl groups derived from 1-butene tetramers and branched hexadecyl groups derived from isobutylene tetramers, including all of branched isomers; an alkylaryl group such as a phenyl group, a tolyl group, an ethylphenyl group and a xylyl group, including all of branched isomers; and an arylalkyl group such as a benzyl group and a phenylethyl group, including all of isomers, are preferable.

Particularly, each of $R^6$ and $R^7$ in the formula (2) may preferably be a branched alkyl group derived from propylene or isobutylene and having 3 to 18 carbon atoms. A branched alkyl group derived from propylene or isobutylene and having 6 to 15 carbon atoms is further preferable.

The content of sulfur in the dihydrocarbyl polysulfide may usually be 10 to 55 wt %, and preferably 20 to 50 wt % for obtaining an excellent extreme-pressure performance, although not limited thereto.

The sulfurized oils and fats for the component (B) may be animal or vegetable oils and fats such as beef tallow, lard, fish oil, rapeseed oil and soybean oil; unsaturated fatty acids such as oleic acid, linolic acid, linolenic acid and fatty acids extracted from the animal or vegetable oils and fats; unsaturated fatty acid esters obtained by reacting the unsaturated fatty acids or acid halides thereof with various alcohols; or mixtures thereof, that naturally contain sulfur, or that have been sulfurized by any methods.

The content of sulfur in the sulfurized oils and fats may usually be 2 to 40 wt %, and preferably 5 to 35 wt % for obtaining an excellent extreme-pressure performance, although not limited thereto.

The lower limit of the content of the component (B) is 0.1 wt % and preferably 0.5 wt %; and the upper limit is 20 wt % and preferably 10 wt %, based on the total amount of the grease composition. If the content of the component (B) is less than 0.1 wt %, the composition cannot exhibit sufficient anti-seizure performance. Addition of more than 20 wt % of the component does not result in further improvement in anti-seizure performance that meets the adding amount.

The present grease composition contains (C) a specific content of a sulfonate selected from the group consisting of an over-based zinc sulfonate, an over-based magnesium sulfonate and mixtures thereof. The lower limit of total base number of the component (C) is 100 mgKOH/g and preferably 150 mgKOH/g; and the upper limit is 500 mgKOH/g and preferably 450 mgKOH/g. If the total base number of the component (C) is less than 100 mgKOH/g, sufficient synergistic effect of components (B) and (C) in the anti-flaking performance cannot be achieved. The component (C) having the total base number of more than 500 mgKOH/g is not readily available.

The term "total base number" in the present invention means the total base number measured by perchloric acid method in accordance with item 7. in JIS K 2501 "Petroleum Products and Lubricants—neutralization value test method".

The component (C) may preferably be an over-based oil-soluble sulfonate selected from the group consisting of an over-based oil-soluble zinc sulfonate, an over-based oil-soluble magnesium sulfonate and mixtures thereof. The examples of such over-based oil-soluble sulfonate may include an over-based oil-soluble zinc sulfonate containing calcium carbonate, an over-based oil-soluble zinc sulfonate containing calcium borate, an over-based oil-soluble magnesium sulfonate containing magnesium carbonate, an over-based oil-soluble magnesium sulfonate containing magnesium borate, and mixtures thereof.

The over-based oil-soluble zinc sulfonate containing calcium carbonate may be prepared by any method. For example, it may be prepared by dispersing a calcium base (such as oxides or hydroxides of calcium) in a neutral zinc sulfonate (normal salt), and blowing carbon dioxide gas into the dispersion, so that the carbon dioxide gas and the calcium base react to generate a calcium carbonate dispersion in the system.

The over-based oil-soluble zinc sulfonate containing calcium borate may be prepared by any method. For example, it may be prepared by dispersing a calcium base (such as oxides or hydroxides of calcium) in a neutral zinc sulfonate (normal salt), and adding boric acid, a salt of boric acid or an ester of boric acid to the system, to generate a calcium borate dispersion in the system; or by reacting the over-based oil-soluble zinc sulfonate containing calcium carbonate with boric acid, a salt of boric acid or an ester of boric acid, to convert the calcium carbonate dispersed in the system to calcium borate.

The over-based oil-soluble magnesium sulfonate containing magnesium carbonate may be prepared by any method. For example, it may be prepared by dispersing a magnesium base (such as oxides or hydroxides of magnesium) in neutral magnesium sulfonate (normal salt), and blowing carbon dioxide gas into the system, so that the carbon dioxide gas and the magnesium base react to generate a magnesium carbonate dispersion in the system.

The over-based oil-soluble magnesium sulfonate containing magnesium borate may be prepared by any method. For example, it may be prepared by dispersing a magnesium base (such as oxides or hydroxides of magnesium) in neutral magnesium sulfonate (normal salt), and adding boric acid, a salt of boric acid or an ester of boric acid to the system, to generate a magnesium borate dispersion in the system; or by reacting the over-based oil-soluble magnesium sulfonate containing magnesium carbonate with boric acid, a salt of boric acid or an ester of boric acid, to convert the magnesium carbonate dispersed in the system to magnesium borate.

These reactions may usually be performed in a solvent, for example, an aliphatic hydrocarbon solvent such as hexane; an aromatic hydrocarbon solvent such as xylene; or a light lubricating base oil.

Examples of the boric acid for producing the over-based oil-soluble zinc sulfonate containing calcium borate or the over-based oil-soluble magnesium sulfonate containing magnesium borate may include orthoboric acid, metaboric acid and tetraboric acid. Examples of the salt of boric acid may include an alkali metal salt, an alkali earth metal salt or an ammonium salt of boric acid. Specifically, lithium borates such as lithium metaborate, lithium tetraborate, lithium pentaborate, lithium perborate; sodium borates such as sodium metaborate, sodium diborate, sodium tetraborate, sodium pentaborate, sodium hexaborate. and sodium octaborate; potassium borates such as potassium metaborate, potassium tetraborate, potassium pentaborate, potassium hexaborate and potassium octaborate; calcium borates such as calcium metaborate, calcium diborate, tricalcium tetraborate, pentacalcium tetraborate and calcium hexaborate; magnesium borates such as magnesium metaborate, magnesium diborate, trimagnesium tetraborate, pentamagnesium tetraborate, magnesium hexaborate; and ammonium borates such as ammonium metaborate, ammonium tetraborate, ammonium pentaborate and ammonium octaborate are preferable.

Examples of the ester of boric acid may include esters of boric acid and alkyl alcohols preferably having 1 to 6 carbon atoms. Specifically, monomethyl borate, dimethyl borate, trimethyl borate, monoethyl borate, diethyl borate, triethyl borate, monopropyl borate, dipropyl borate, tripropyl borate, monobutyl borate, dibutyl borate and tributyl borate are preferable.

Examples of the neutral zinc sulfonate (normal salt) for producing the over-based oil-soluble zinc sulfonate may include a zinc natural salt of an alkyl aromatic sulfonic acid which has been produced by sulfonation of an alkyl aromatic compound having a weight average molecular weight of 100 to 1500, preferably 200 to 700. The alkyl aromatic sulfonic acid may be petroleum sulfonic acid or synthetic sulfonic acid.

Examples of the neutral magnesium sulfonate (normal salt) for producing the over-based oil-soluble magnesium ulfonate may include a magnesium natural salt of an alkyl aromatic sulfonic acid which has been produced by sulfonation of an alkyl aromatic compound having a weight average molecular weight of 100 to 1500, preferably 200 to 700. The alkyl aromatic sulfonic acid may be petroleum sulfonic acid or synthetic sulfonic acid.

The petroleum sulfonic acid may be a sulfonated product of an alkyl aromatic compound from lubricant fractions of a mineral oil, or so called mahogany acid, which is a by-product of white oil. The synthetic sulfonic acid may be a sulfonated product of alkylbenzene having straight or branched alkyl group(s), or a sulfonated product of alkylnaphthalene. The alkylbenzene may be a by-product produced in a plant for manufacturing alkylbenzene as a material for detergent, or an alkylated product of benzene with polyolefin. The alkylnaphthalene may be dinonylnaphthalene. There is no limitation to the sulfonating agent for sulfonating the alkyl aromatic compounds. However, fuming sulfuric acid or sulfuric anhydride may usually be used.

As the component (C), commercially available products in a diluted form with light lubricating base oil may also be used.

The content of zinc and/or magnesium in the component (C) is not particularly limited. However, the total content of zinc and/or magnesium in the component (C) may be 0.5 to 30 wt %, preferably 1 to 25 wt %, and more preferably 1 to 20 wt %, for synergistic anti-flaking effect in the present composition.

The lower limit of the content of the component (C) is 0.05 wt % and preferably 0.1 wt %; and the upper limit is 10 wt % and preferably 5 wt %, based on the total amount of the grease composition. If the content of the component (C) is less than 0.05 wt %, sufficient synergistic effect of the components (B) and (C) cannot be achieved in the anti-flaking performance. Addition of more than 10 wt % of the component (C) does not result in further improvement in anti-flaking performance that meets the adding amount.

If necessary, the present grease composition may contain other additives for further improving the properties, as long as such other additives do not damage the properties of the grease composition.

Examples of such other additives may include a solid lubricant, an extreme pressure agent other than the component (B), an anti-oxidant, an oiliness agent, a rust-inhibitor, and a viscosity index improver.

Examples of the solid lubricant may include graphite, fluorinated graphite, boron nitride, polytetrafluoroethylene, molybdenum disulfide, antimony sulfide, and alkali or alkali earth metal borate.

Examples of the extreme pressure agent other than the component (B) may include organozinc compounds such as zinc dialkyl dithiophosphate, zinc diaryl dithiophosphate and zinc dialkyl dithiocarbamate; organomolybdenum compounds such as molybdenum dialkyl dithiophosphate, molybdenum diaryl dithiophosphate and molybdenum dialkyl dithiocarbamate; thiocarbamyl compounds; and phosphates and phosphites.

Examples of the anti-oxidant may include phenol compounds such as 2,6-di-t-butylphenol and 2,6-di-t-butyl-p-cresol; amine compounds such as dialkyldiphenylamine, phenyl-α-naphthylamine and p-alkylphenyl-α-naphthylamine; sulfur compounds; and phenothiazine compounds.

Examples of the oiliness agent may include amines such as lauryl amine, myristyl amine, palmityl amine, stearyl amine and oleyl amine; higher alcohols such as lauryl alcohol, myristyl alcohol, palmityl alcohol, stearyl alcohol and oleyl alcohol; higher fatty acids such as layric acid, myristic acid, palmitic acid, stearic acid and oleylic acid; fatty acid esters such as methyl laurate, methyl myristate, methyl palmitate, methyl stearate and methyl oleate; amides such as lauryl amide, myristyl amide, palmityl amide, stearyl amide and oleyl amide; and oils and fats.

Examples of the rust-inhibitor may include metal soaps; partial esters of polyalcohols such as sorbitan fatty acid ester; amines; phosphoric acid; and phosphates.

Examples of the viscosity index improver may include polymethacrylate, polyisobutylene and polystylene.

The grease composition of the present invention may be produced, for example, by adding the components (A) to (C) and optionally other additives to the lubricating base oil, agitating the resulting mixture, and passing the mixture through a roll mill. Alternatively, the grease composition of the present invention may be produced by preparing the thickener component (A) in a lubricating base oil in advance, further adding the components (B) and (C) and other optional additives to the mixture, agitating the resulting mixture, and passing the mixture through the roll mill. The preparation of the component (A) in the lubricating base oil may be performed by adding materials for producing the thickener component (A) to the lubricating base oil, and melting and agitating the mixture.

The grease composition of the present invention has excellent anti-flaking property, anti-seizure property and low-friction property, and is therefore useful as a grease for, e.g., a constant velocity gear, a speed-change gear and an iron manufacturing plant. Particularly, the grease composition of the present invention is useful for constant velocity joints including fixed type joints such as a Birfield joint, a Rzeppa joint and an undercutting free joint, and slide type joints such as a double off-set joint, a tripod joint and a cross groove joint.

EXAMPLES OF THE INVENTION

The present invention will be explained more in detail referring to the Examples and Comparative Examples, but the present invention is not limited thereto.

Examples 1 to 4 and Comparative Examples 1 to 6

As a lubricating base oil, a solvent-purified paraffin mineral oil having a kinematic viscosity of 15 $mm^2/s$ at 100° C. was employed. Diphenylmethane-4,4'-diisocyanate in an amount shown in Table 1 was dissolved in the base oil under heating. Subsequently, amines and an alcohol shown in Table 1 that have been dissolved under heating in the same base oil were further added, for obtaining the component (A) in a gel form. The composition of the component (A) obtained in each Example is as follows:

Component (A) in Example 1 (molar ratio of the terminal cyclohexyl group/stearyl group=7/3)

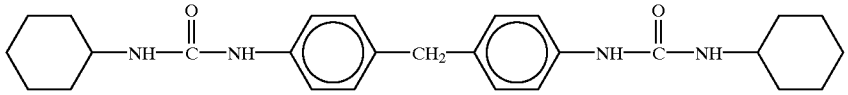

+

-continued

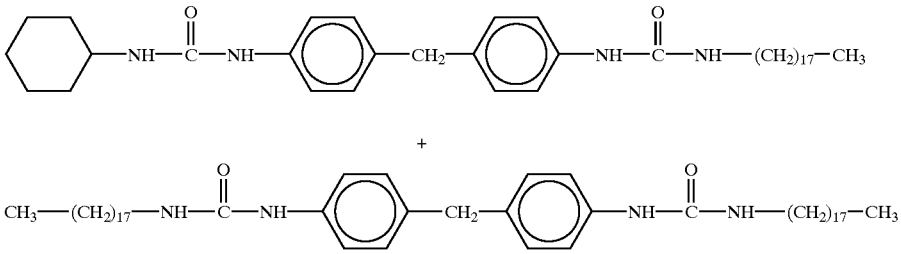

Component (A) in Example 2 (molar ratio of the terminal cyclohexyl group/stearyl group=8/2)

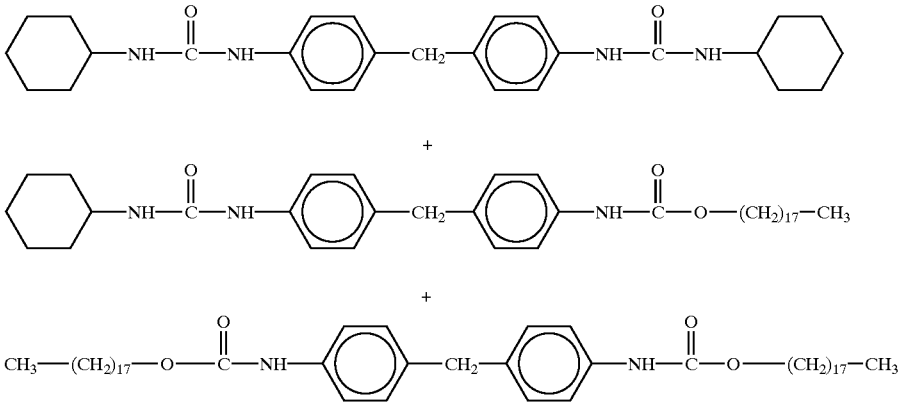

Component (A) in Example 3

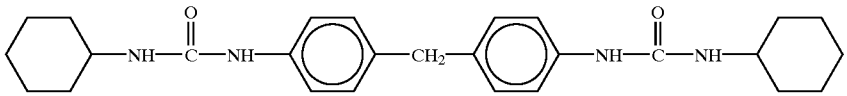

Component (A) in Example 4

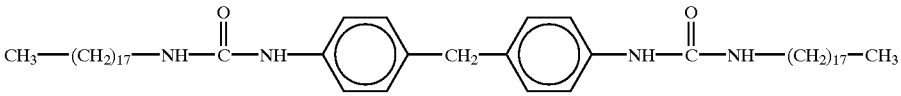

To the generated gel of the component (A) were added various additives shown in Table 1. Each resulting mixture was agitated and passed through a roll mill, to produce each grease composition. In Comparative Example 1, the grease composition was prepared by dissolving lithium 12-hydroxystearate in place of the component (A) in the lubricating base oil, adding various additives shown in Table 1 to the mixture, agitating the mixture, and passing the mixture through a roll mill.

On each grease composition, the following on-bench durability test 1 was performed. The results are shown in Table 1.

On-bench Durability Test 1

A cycle of change in rotation, torque and working angle was defined considering a driving pattern of a car. A commercially available #87 size Birfield joint was run in accordance with the cycle. The number of cycles until the expiration of the life of the joint was evaluated.

As evident from the results of the on-bench durability test shown in Table 1, the present grease composition can significantly extend the lifetime of the constant velocity joint, compared to the grease composition of Comparative Example 1 employing as a thickener a compound other than the component (A), the grease composition of Comparative Example 2 that does not contain the component (B), the grease compositions of Comparative Examples 3 and 4 that do not contain the component (C), and the grease composition of Comparative Example 5 employing a neutral zinc sulfonate in place of the component (C). In case of the grease composition in Comparative Example 6 not containing the components (B) nor (C), seizure occurred in the beginning of the on-bench durability test, and further test was not able to be performed.

TABLE 1

| | Examples | | | | Comparative Examples | | | | | |
|---|---|---|---|---|---|---|---|---|---|---|
| | 1 | 2 | 3 | 4 | 1 | 2 | 3 | 4 | 5 | 6 |
| Lubricant base oil[1] (wt %) | 77.5 | 76.0 | 69.0 | 70.0 | 79.5 | 79.5 | 78.0 | 78.0 | 77.5 | 80.0 |
| (A) | | | | | | | | | | |
| Amount of thickener (wt %) | 12.0 | 10.0 | 20.0 | 15.0 | 10.0 | 12.0 | 12.0 | 12.0 | 12.0 | 12.0 |
| Thickeners (molars ratio) | | | | | | | | | | |
| Diphenylmethane-4,4'-diisocyanate | 5 | 5 | 1 | 1 | Thick- | 5 | 5 | 5 | 5 | 5 |
| Cyclohexylamine | 7 | 8 | 2 | — | ener[8] | 7 | 7 | 7 | 7 | 7 |
| Stearylamine | 3 | — | — | 2 | | 3 | 3 | 3 | 3 | 3 |
| Stearyl alcohol | — | 2 | — | — | | — | — | — | — | — |
| (B) | | | | | | | | | | |
| Dihydrocarbyl polysulfide[2] (wt %) | 2.0 | 4.0 | — | — | 2.0 | — | 2.0 | — | 2.0 | — |
| Sulfurized oil and fat[3] (wt %) | — | — | 2.0 | 5.0 | — | — | — | 2.0 | — | — |
| (C) | | | | | | | | | | |
| Over-based zinc sulfonate[4] (wt %) | 0.5 | 2.0 | 1.0 | 2.0 | 0.5 | 0.5 | — | — | — | — |
| Anti-oxidant[5] (wt %) | 3.0 | 3.0 | 3.0 | 3.0 | 3.0 | 3.0 | 3.0 | 3.0 | 3.0 | 3.0 |
| Other extreme pressure agent[6] (wt %) | 5.0 | 5.0 | 5.0 | 5.0 | 5.0 | 5.0 | 5.0 | 5.0 | 5.0 | 5.0 |
| Neutral zinc sulfonate[7] (wt %) | — | — | — | — | — | — | — | — | 0.5 | — |
| On-bench durability test 1 (cycles) | 400 | 473 | 368 | 421 | 123 | 5 | 76 | 44 | 95 | <1 |

[1]Paraffin mineral oil purified with solvent (kinematic viscosity of 15 $mm^2/s$ (100° C.))
[2]Sulfurized polyisobutylene (sulfur content of 45 wt %)
[3]Sulfurized lard (sulfur content of 30 wt %)
[4]Petroleum Sulfonate (total base number of 300 mgKOH/g)
[5]Amine anti-oxidant
[6]Molybdenum disulfide (2 wt %), molybdenum dithiocarbamate (2 wt %), oilness agent (1 wt %)
[7]Petrol type (total base number of 0 mgKOH/g)
[8]Lithium salt of 12-hydroxystearic acid

Examples 5 to 8 and Comparative Examples 7 to 12

As a lubricating base oil, a solvent-purified paraffin mineral oil having a kinematic viscosity of 15 $mm^2/s$ at 100° C. was employed. Diphenylmethane-4,4'-diisocyanate in an amount shown in Table 1 was dissolved in the base oil under heating. Subsequently, amines and an alcohol shown in Table 2 that have been dissolved under heating in the same base oil were further added, for obtaining the component (A) in a gel form. The composition of the component (A) obtained in each of Examples 5 to 8 is the same as that in Examples 1 to 4, respectively.

To the generated gel of the component (A) were added various additives shown in Table 2. Each resulting mixture was agitated and passed through a roll mill, to produce each grease composition. In Comparative Example 7, the grease composition was prepared by dissolving lithium 12-hydroxystearate in place of the component (A) in the lubricating base oil, adding various additives shown in Table 2 to the mixture, agitating the mixture, and passing the mixture through a roll mill.

On each grease composition, the following on-bench durability test 2 was performed. The results are shown in Table 2.

On-bench Durability Test 2

A tripod slide joint was employed. On-bench durability test was performed at the rotation of 1500 rpm, torque of 30 kgf·m and working angle of 7 deg. The time until the expiration of the life of the joint was evaluated.

As evident from the results of the on-bench durability test shown in Table 2, the present grease composition can significantly extend the lifetime of the constant velocity joint, compared to the grease composition of Comparative Example 7 employing as a thickener a compound other than the component (A), the grease composition of Comparative Example 8 that does not contain the component (B), the grease compositions of Comparative Examples 9 and 10 that do not contain the component (C), and the grease composition of Comparative Example 11 employing a neutral magnesium sulfonate in place of the component (C) . In the case of the grease composition in Comparative Example 12 not containing the components (B) nor (C), seizure occurred in the beginning of the on-bench durability test, and further test was not able to be performed.

TABLE 2

| | Example | | | Comparative Example | | | | | |
|---|---|---|---|---|---|---|---|---|---|
| | 6 | 7 | 8 | 7 | 8 | 9 | 10 | 11 | 12 |
| Lubricant base oil[9] (wt %) | 74.0 | 67.0 | 68.0 | 77.5 | 77.5 | 76.0 | 76.0 | 75.5 | 78.0 |
| (A) | | | | | | | | | |
| Amount of thickener (wt %) | 10 | 20.0 | 15.0 | 10.0 | 12.0 | 12.0 | 12.0 | 12.0 | 12.0 |
| Thickeners | | | | | | | | | |

TABLE 2-continued

| | Example | | | Comparative Example | | | | | |
|---|---|---|---|---|---|---|---|---|---|
| | 6 | 7 | 8 | 7 | 8 | 9 | 10 | 11 | 12 |
| (molars ratio) | | | | | | | | | |
| Diphenylmethane-4,4'-diisocyanate | 5 | 1 | 1 | Thick- | 5 | 5 | 5 | 5 | 5 |
| Cyclohexylamine | 8 | 2 | — | ener[16]) | 7 | 7 | 7 | 7 | 7 |
| Stearylamine | — | — | 2 | | 3 | 3 | 3 | 3 | 3 |
| Stearyl alcohol | 2 | — | — | | — | — | — | — | — |
| (B) | | | | | | | | | |
| Dihydrocarbyl polysulfide[10)] (wt %) | 4.0 | — | — | 2.0 | — | 2.0 | — | 2.0 | — |
| Sulfurized oil and fat[11)] (wt %) | — | 2.0 | 5.0 | — | — | — | 2.0 | — | — |
| (C) | | | | | | | | | |
| Over-based magnesium sulfonate[12)] (wt %) | 2.0 | 1.0 | 2.0 | 0.5 | 0.5 | — | — | — | — |
| Anti-oxidant[13)] (wt %) | 3.0 | 3.0 | 3.0 | 3.0 | 3.0 | 3.0 | 3.0 | 3.0 | 3.0 |
| Other extreme pressure agent[14)] (wt %) | 7.0 | 7.0 | 7.0 | 7.0 | 7.0 | 7.0 | 7.0 | 7.0 | 7.0 |
| Neutral magnesium sulfonate[15)] (wt %) | — | — | — | — | — | — | — | 0.5 | — |
| On-bench durability test 2 (hours) | 1530 | 1240 | 1360 | 750 | 210 | 380 | 290 | 370 | <50 |

[9)]Paraffin mineral oil purified with solvent (kinematic viscosity of 15 $mm^2/s$ (100° C.))
[10)]Sulfurized polyisobutylene (sulfur content of 45 wt %)
[11)]Sulfurized lard (sulfur content of 30 wt %)
[12)]Petroleum Sulfonate (total base number of 400 mgKOH/g)
[13)]Amine anti-oxidant
[14)]Molybdenum disulfide (2 wt %), molybdenum dithiocarbamate (2 wt %), molybdenum dithiophosphate (2 wt%), oilness agent (1 wt %)
[15)]Petrol type (total base number of 0 mgKOH/g)
[16)]Lithium salt of 12-hydroxystearic acid Although the present invention has been described with reference to the preferred examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A grease composition comprising a lubricating base oil, and:

(A) 2 to 30 wt % of a thickener selected from the group consisting of a urea compound, a urea-urethane compound, a urethane compound and mixture thereof, (B) 0.1 to 20 wt % of a sulfur-containing extreme pressure agent selected from the group consisting of dihydrocarbyl polysulfide, sulfurized oils and fats and mixtures thereof, and (C) 0.05 to 10 wt % of a sulfonate selected from the group consisting of an over-based zinc sulfonate, an over-based magnesium sulfonate and mixtures thereof, having total base number of 100 to 500 mgKOH/g, each based on a total amount of said grease composition.

2. The grease composition of claim 1 wherein said lubricating base oil is selected from the group consisting of a mineral oil, a synthetic oil and mixtures thereof.

3. The grease composition of claim 1 wherein said lubricating base oil has a kinematic viscosity of 2 to 40 $mm^2/s$ at 100° C.

4. The grease composition of claim 1 wherein said component (A) is one or more of compounds represented by the general formula (1):

$$A—CONH—R^1—NHCO—B \quad (1)$$

wherein $R^1$ denotes a divalent hydrocarbon group; A and B are the same or different groups and denote —NHR , —$NR^3R^4$ or —$OR^5$; and $R^2$, $R^3$, $R^4$ and $R^5$ are the same or different groups and denote a hydrocarbon residue having 6 to 20 carbon atoms.

5. The grease composition of claim 1 wherein the content of the component (A) based on the total amount of said composition is 5 to 20 wt %.

6. The grease composition of claim 1 wherein said component (B) contains dihydrocarbyl polysulfide represented by the formula (2);

$$R^6—(S)x-R^7 \quad (2)$$

wherein $R^6$ and $R^7$ are the same or different groups, and each stands for a straight or branched alkyl group having 3 to 20 carbon atoms, or an aryl, alkylaryl or arylalkyl group having 6 to 20 carbon atoms; and X stands for a number of 2 to 6.

7. The grease composition of claim 6 wherein the content of sulfur in said dihydrocarbyl polysulfide is 10 to 55 wt %.

8. The grease composition of claim 1 wherein the content of sulfur in said sulfurized oils and fats is 2 to 40 wt %.

9. The grease composition of claim 1 wherein the content of said component (B) based on the total amount of said composition is 0.5 to 10 wt %.

10. The grease composition of claim 1 wherein said component (C) is selected from the group consisting of an over-based oil-soluble zinc sulfonate, an over-based oil-soluble magnesium sulfonate and mixtures thereof.

11. The grease composition of claim 11 wherein said over-based oil-soluble zinc sulfonate is selected from the group consisting of an over-based oil-soluble zinc sulfonate containing calcium carbonate and an over-based oil-soluble zinc sulfonate containing calcium borate, and wherein said over-based oil-soluble magnesium sulfonate is selected from the group consisting of an over-based oil-soluble magnesium sulfonate containing magnesium carbonate and an over-based oil-soluble magnesium sulfonate containing magnesium borate.

12. The grease composition of claim 1 wherein the total content of zinc and/or magnesium in the component (C) is 0.5 to 30 wt %.

13. The grease composition of claim 1 wherein the content of said component (C) based on total amount of said composition is 0.1 to 5 wt %.

14. The grease composition of claim 1 further comprising additives selected from the group consisting of a solid lubricant, an extreme pressure agent other than said component (B), an anti-oxidant, an oiliness agent, a rust-inhibitor, a viscosity index improver.

* * * * *

UNITED STATES PATENT AND TRADEMARK OFFICE

CERTIFICATE OF CORRECTION

PATENT NO. : 6,432,889 B1 
DATED : August 13, 2002
INVENTOR(S) : Hirotugu Kinoshita and Kiyomi Sakamoto It is certified that error appears in the above-identified patent and that said Letters Patent is hereby corrected as shown below:

Column 13,
Line 6, delete "—NHR" and substitute -- —$NHR^2$ --.

Column 14,
Line 1, delete "claim 11" and substitute -- claim 10 --.

Signed and Sealed this

First Day of July, 2003

JAMES E. ROGAN
*Director of the United States Patent and Trademark Office*